US008781343B2

(12) United States Patent
Hayashi et al.

(10) Patent No.: US 8,781,343 B2
(45) Date of Patent: Jul. 15, 2014

(54) TONER CONSUMPTION CALCULATOR, IMAGE FORMING APPARATUS, AND TONER CONSUMPTION CALCULATION METHOD

(75) Inventors: Masayuki Hayashi, Osaka (JP); Yoshinori Shirasaki, Osaka (JP); Kunihiro Komai, Osaka (JP); Hiroaki Ikeda, Osaka (JP); Motoyoshi Takahashi, Osaka (JP); Fuminori Tsuchiya, Osaka (JP); Akinori Yamaguchi, Osaka (JP); Tatsuya Miyadera, Osaka (JP); Motohiro Kawanabe, Osaka (JP); Yasuo Yamaguchi, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/609,833

(22) Filed: Sep. 11, 2012

(65) Prior Publication Data

US 2013/0071130 A1 Mar. 21, 2013

(30) Foreign Application Priority Data

Sep. 16, 2011 (JP) ..... 2011-203845

(51) Int. Cl.
*G03G 15/28* (2006.01)

(52) U.S. Cl.
USPC ..... 399/27; 399/301

(58) Field of Classification Search
CPC ..... G03G 15/556
USPC ..... 399/27–28
See application file for complete search history.

(56) References Cited

U.S. PATENT DOCUMENTS

| | | | | |
|---|---|---|---|---|
| 6,895,193 | B2 * | 5/2005 | Takamatsu et al. | 399/27 |
| 7,558,494 | B2 * | 7/2009 | Hatakeyama | 399/27 |
| 7,973,952 | B2 * | 7/2011 | Ono | 358/1.14 |
| 2007/0166059 | A1 | 7/2007 | Kin et al. | |

FOREIGN PATENT DOCUMENTS

| | | | |
|---|---|---|---|
| JP | 06-202472 | | 7/1994 |
| JP | 2005-184607 | | 7/2005 |
| JP | 2007-078794 | | 3/2007 |
| JP | 2007-174571 | | 7/2007 |
| JP | 2007174571 | A * | 7/2007 |
| JP | 2008046488 | A * | 2/2008 |
| JP | 2008-070796 | | 3/2008 |

* cited by examiner

*Primary Examiner* — Clayton E Laballe
*Assistant Examiner* — Leon W Rhodes, Jr.
(74) *Attorney, Agent, or Firm* — Oblon, Spivak, McClelland, Maier & Neustadt, L.L.P.

(57) ABSTRACT

A toner consumption calculator includes a plurality of line memories; a recorder that sequentially records image data including a plurality of pixels into the line memories; a skew correction unit that performs skew correction on the image data by sequentially reading the image data from the line memories while controlling read timing; and a counter that sequentially reads the image data from the line memories and counts toner consumption of a target pixel on the basis of light amounts of surrounding pixels of the target pixel.

10 Claims, 13 Drawing Sheets

TONER CONSUMPTION CALCULATOR, IMAGE FORMING APPARATUS, AND TONER CONSUMPTION CALCULATION METHOD

CROSS-REFERENCE TO RELATED APPLICATIONS

The present application claims priority to and incorporates by reference the entire contents of Japanese Patent Application No. 2011-203845 filed in Japan on Sep. 16, 2011.

BACKGROUND OF THE INVENTION

1. Field of the Invention

The present invention relates to a toner consumption calculator, an image forming apparatus, and a toner consumption calculation method.

2. Description of the Related Art

In electrophotographic image forming apparatuses that perform exposure using light emitting diode arrays (LEDAs), techniques have been known that correct color shifts caused by skews and bows due to variations in chip arrangements of the LEDAs (e.g., refer to Japanese Patent Application Laid-open No. 2007-174571).

In the image forming apparatuses, techniques also have been known that calculate toner consumption taking into consideration an effect on a target pixel by light emitted to surrounding pixels of the target pixel (e.g., refer to Japanese Patent Application Laid-open No. 2007-078794). Such techniques can calculate the toner consumption with high accuracy.

The techniques disclosed in Japanese Patent Application Laid-open No. 2007-174571 and Japanese Patent Application Laid-open No. 2007-078794 need a large number of line memories, thereby increasing the number of built-in line memories and cost for the line memories.

Therefore, there is a need for a toner consumption calculator, an image forming apparatus, and a toner consumption calculation method that are capable of performing color shift correction and toner consumption calculation with high accuracy and at low cost.

SUMMARY OF THE INVENTION

According to an embodiment, there is provided a toner consumption calculator that includes a plurality of line memories; a recorder that sequentially records image data including a plurality of pixels into the line memories; a skew correction unit that performs skew correction on the image data by sequentially reading the image data from the line memories while controlling read timing; and a counter that sequentially reads the image data from the line memories and counts toner consumption of a target pixel on the basis of light amounts of surrounding pixels of the target pixel.

According to another embodiment, there is provided an image forming apparatus that includes the toner consumption calculator described above.

According to still another embodiment, there is provided a toner consumption calculation method that includes, by a recorder, sequentially recording image data including a plurality of pixels into a plurality of line memories; by a skew correction unit, performing skew correction on the image data by sequentially reading the image data from the line memories while controlling read timing; and by a counter, sequentially reading the image data from the line memories and counting toner consumption of a target pixel on the basis of light amounts of surrounding pixels of the target pixel.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

Embodiments of a toner consumption calculator, an image forming apparatus, and a toner consumption calculation method according to the present invention are described in detail below with reference to the accompanying drawings. In the following embodiment, an example is described in which the image forming apparatus including the toner consumption calculator of the invention is applied to an electrophotographic printing apparatus. The invention, however, is not limited to being applied to the electrophotographic printing apparatus. The invention can be applied to any apparatuses that form images by electrophotography, such as electrophotographic copiers and multifunction peripherals (MFPs). The MFPs have at least two functions out of printing, copying, scanning, and facsimile functions.

Figure 1:
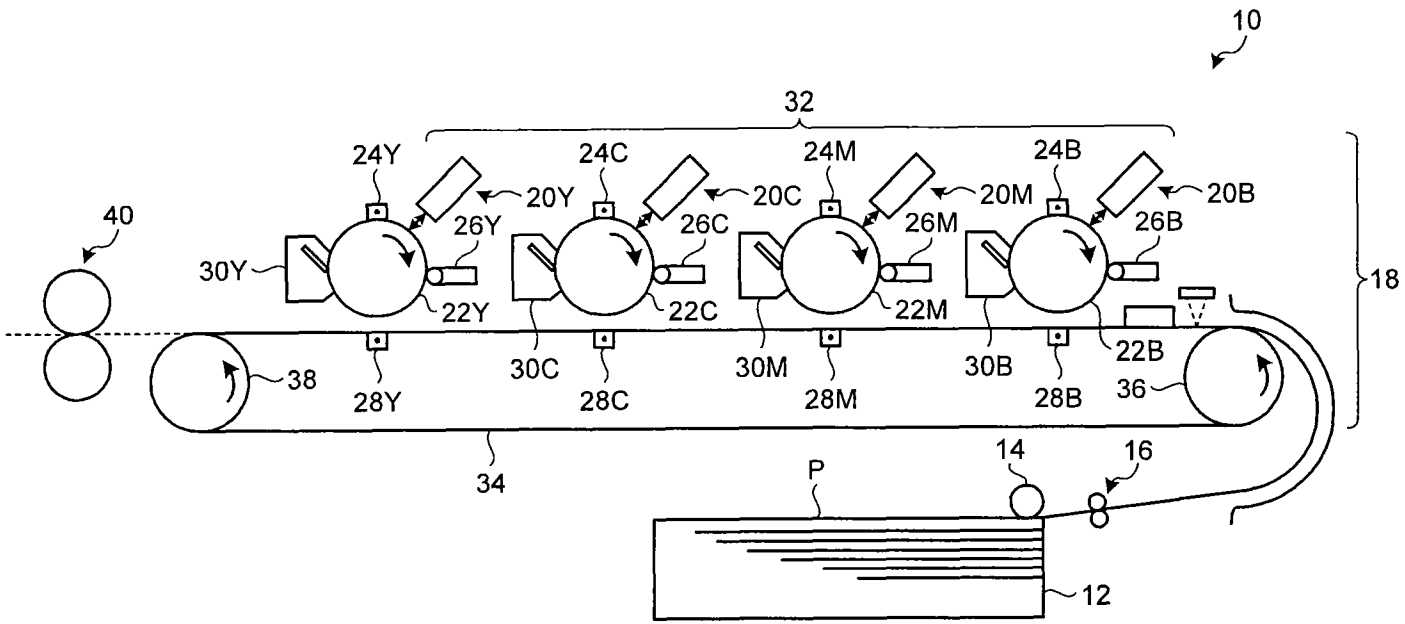
FIG. 1 is a schematic diagram illustrating an example of a mechanical structure of a printing apparatus of an embodiment of the present invention.

FIG. 1 is a schematic diagram illustrating an example of a mechanical structure of a printing apparatus 10 of the embodiment.

As illustrated in FIG. 1, the printing apparatus 10 includes a paper cassette 12, a paper feeding roller 14, a separation roller pair 16, an image forming unit 18, and a fixing unit 40. FIG. 1 illustrates a so-called tandem printing apparatus in which image forming sections for respective colors are arranged along a conveying belt, which is described later. The printing apparatus, however, is not limited to the tandem type.

The paper cassette 12 houses a plurality of recording sheets in a stacked manner.

The paper feeding roller 14 abuts a recording sheet P located at the uppermost position in the paper cassette 12 and feeds the abutting recording sheet P.

The separation roller pair 16 sends the recording sheet P fed by the paper feeding roller 14 to the image forming unit 18. When two or more recording sheets are fed by the paper feeding roller 14, the separation roller pair 16 separates the recording sheet P from the other recording sheets by pushing back the other recording sheets, and sends only the recording sheet P to the image forming unit 18.

The image forming unit 18, which forms an image on the recording sheet P sent from the separation roller pair 16, includes image forming sections 20B, 20M, 20C, and 20Y, an LEDA head 32, a conveying belt 34, a driving roller 36, and a driven roller 38.

The image forming sections 20B, 20M, 20C, and 20Y are arranged in this order along the conveying belt 34 from an upstream side in a conveying direction of the conveying belt 34 conveying the recording sheet P sent from the separation roller pair 16.

The image forming section 20B includes a photosensitive drum 22B, and a charger 24B, a developing unit 26B, a transfer unit 28B, a photosensitive-element cleaner (not illustrated), and a neutralization device 30B that are arranged around the photosensitive drum 22B. The image forming section 20B and the LEDA head 32 form a black toner image on the photosensitive drum 22B by image forming processing (charging, exposing, developing, transfer, cleaning, and neutralization processes) on the photosensitive drum 22B.

Each of the image forming sections 20M, 20C, and 20Y has the same common components as the image forming section 20B. The image forming section 20M forms a magenta toner image by the image forming processing. The image forming section 20C forms a cyan toner image by the image forming processing. The image forming section 20Y forms a yellow toner image by the image forming processing. Therefore, the components of the image forming section 20B are primarily described below. The respective components of the image forming sections 20M, 20C, and 20Y are labeled with the respective suffixes of M, C, and Y instead of the suffix B for the components of the image forming section 20B, and descriptions thereof are omitted.

The photosensitive drum 22B (an example of an image carrier) is rotated by a driving motor (not illustrated).

First, in the charging process, the charger 24B uniformly charges in the dark an outer circumferential surface of the photosensitive drum 22B that is being rotated.

Then, in the exposing process, the LEDA head 32 (an example of an exposing unit) exposes the outer circumferential surface of the photosensitive drum 22B that is being rotated by irradiation light corresponding to a black image to form a static latent image based on the black image on the photosensitive drum 22B. The LEDA head 32 exposes the outer circumferential surface of the photosensitive drum 22M by irradiation light corresponding to a magenta image, the outer circumferential surface of the photosensitive drum 22C by irradiation light corresponding to a cyan image, and the outer circumferential surface of the photosensitive drum 22Y by irradiation light corresponding to a yellow image.

Then, in the developing process, the developing unit 26B develops the static latent image formed on the photosensitive drum 22B by black toner to form a black toner image on the photosensitive drum 22B.

Then, in the transfer process, the transfer unit 28B transfers the black toner image formed on the photosensitive drum 22B onto the recording sheet P at a transfer position at which the photosensitive drum 22B and the recording sheet P conveyed by the conveying belt 34 make contact with each other. A slight amount of non-transferred toner remains on the photosensitive drum 22B after the toner image is transferred.

Then, in the cleaning process, the photosensitive-element cleaner removes the non-transferred toner remaining on the photosensitive drum 22B.

Lastly, in the neutralization process, the neutralization device 30B neutralizes potential remaining on the photosensitive drum 22B. Then, the image forming section 20B waits for the next image forming.

The conveying belt 34 is an endless belt winded and circulated between the driving roller 36 and the driven roller 38. The recording sheet P sent from the separation roller pair 16 adheres to the conveying belt 34 by static adhesion. The conveying belt 34 is moved in an endless manner by the driving roller 36 rotated by a driving motor (not illustrated) and conveys the recording sheet P adhering thereto to the image forming sections 20B, 20M, 20C, and 20Y in this order.

First, the image forming section 20B transfers the black toner image onto the recording sheet P conveyed by the conveying belt 34. Then, the image forming sections 20M, 20C, and 20Y transfer the magenta toner image, the cyan toner image, and the yellow toner image onto the recording sheet P in an overlapped manner, respectively. As a result, a full-color image is formed on the recording sheet P.

The fixing unit 40 fixes on the recording sheet P the full-color image formed through the image forming sections 20B, 20M, 20C, and 20Y, by heating and pressuring the recording sheet P having been removed from the conveying belt 34. The recording sheet P on which the image has been fixed is discharged outside the printing apparatus 10.

Figure 2:
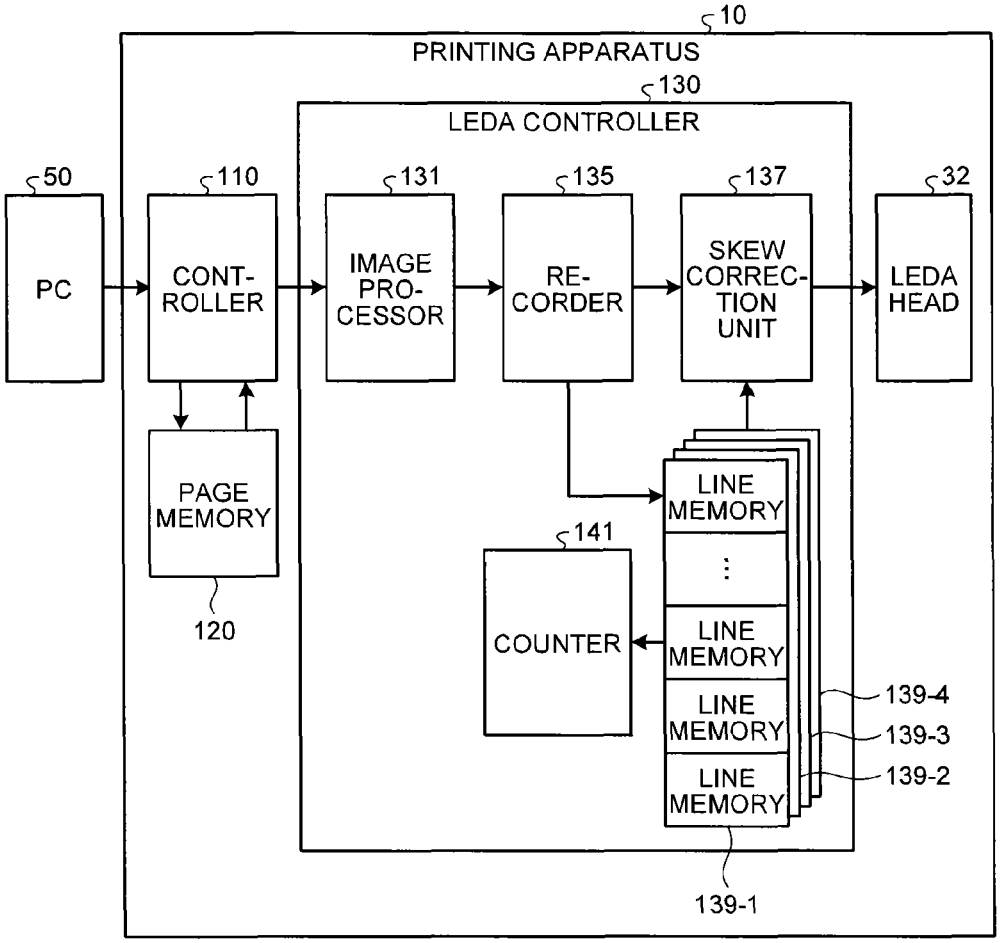
FIG. 2 is a block diagram illustrating an example of a functional structure of the printing apparatus of the embodiment.

FIG. 2 is a block diagram illustrating an example of a functional structure of the printing apparatus 10 of the embodiment. As illustrated in FIG. 2, the printing apparatus 10 includes a controller 110, a page memory 120, an LEDA controller 130, and the LEDA head 32. The LEDA controller 130 is included in an example of the toner consumption calculator.

The controller 110 receives print data generated by a PC 50 (a printer driver installed in the PC 50) through a network (not illustrated). The print data is described by a page description language (PDL), for example. The controller 110 converts the received print data into image data (e.g., bit map data) composed of a plurality of pixels in the page memory 120 and transfers the converted image data to the LEDA controller 130 line by line.

The LEDA controller 130 causes the LEDA head 32 to emit light on the basis of the image data transferred from the controller 110 line by line so as to form the static latent image. That is, the LEDA controller 130 uses the image data transferred from the controller 110 as light-emitting data. The LEDA controller 130 includes an image processor 131, a recorder 135, a skew correction unit 137, a plurality of line memories 139-1 to 139-4, and a counter 141.

The LEDA controller 130 includes a plurality of channels (not illustrated) of a channel 0 (ch0) to a channel 3 (ch3). The image data transferred from the controller 110 line by line is input to the channels provided for respective colors and transferred to the image processor 131, the recorder 135, and the line memories 139-1 to 139-4 in this order. The image processor 131, the recorder 135, the skew correction unit 137, and the counter 141 perform the following processes on the image data of the respective colors transferred from the ch0 to the ch3 line by line.

In the embodiment, image data of black, image data of cyan, image data of magenta, and image data of yellow are input to the ch0, the ch1, the ch2, and the ch3, respectively, and also input to the line memories 139-1, 139-2, 139-3, and 139-4, respectively. The combination of the image data of the respective colors, the channels, and the line memories is not limited to above combination.

The image processor 131 performs image processing on the image data transferred from the controller 110 line by line and then transfers the processed data to the skew correction unit 137 line by line. Examples of the image processing include processing to add internal patterns and trimming. When processing that requires the line memory, such as jaggy correction, is performed as the image processing, for example, the LEDA controller 130 includes the line memory for the image processor 135.

The recorder 135 sequentially records the image data into the corresponding line memories out of the line memories 139-1 to 139-4.

The skew correction unit 137 performs skew correction on the image data by sequentially reading the image data from the corresponding line memories out of the line memories 139-1 to 139-4 while controlling read timing, and transfers the resulting image data to the LEDA head 32 line by line. For example, the skew correction unit 137 performs the skew correction on the image data illustrated in FIG. 3 so as to be the image data illustrated in FIG. 4 after the correction. In the embodiment, the skew correction unit 137 corrects a bow of the LEDA head 32 by the skew correction. The skew correction, however, is not limited to correction of the bow, and may correct a slant of an image caused by the image data.

The skew correction unit 137 performs skew correction on the image data whose resolution in the main-scanning direction has been increased L times (L is a natural number) by increasing the number of pixels processed in a single operation of the skew correction L times. The skew correction unit 137 increases resolution in the sub-scanning direction N times by reading the image data N times (N is a natural number).

The LEDA head 32 emits light on the basis of the image data transferred from the skew correction unit 137 line by line to form the static latent image.

The counter 141 sequentially reads the image data from the corresponding line memories out of the line memories 139-1 to 139-4 and counts the toner consumption of a target pixel on the basis of light amounts of surrounding pixels of the target pixel. The counter 141 reads the image data during a time when the skew correction unit 137 is not reading image data from the corresponding line memories. The number of pixels processed in a single operation of the skew correction performed by the skew correction unit 137 may differ from the number of pixels processed in a single operation of the toner consumption counting performed by the counter 141.

Figure 5:
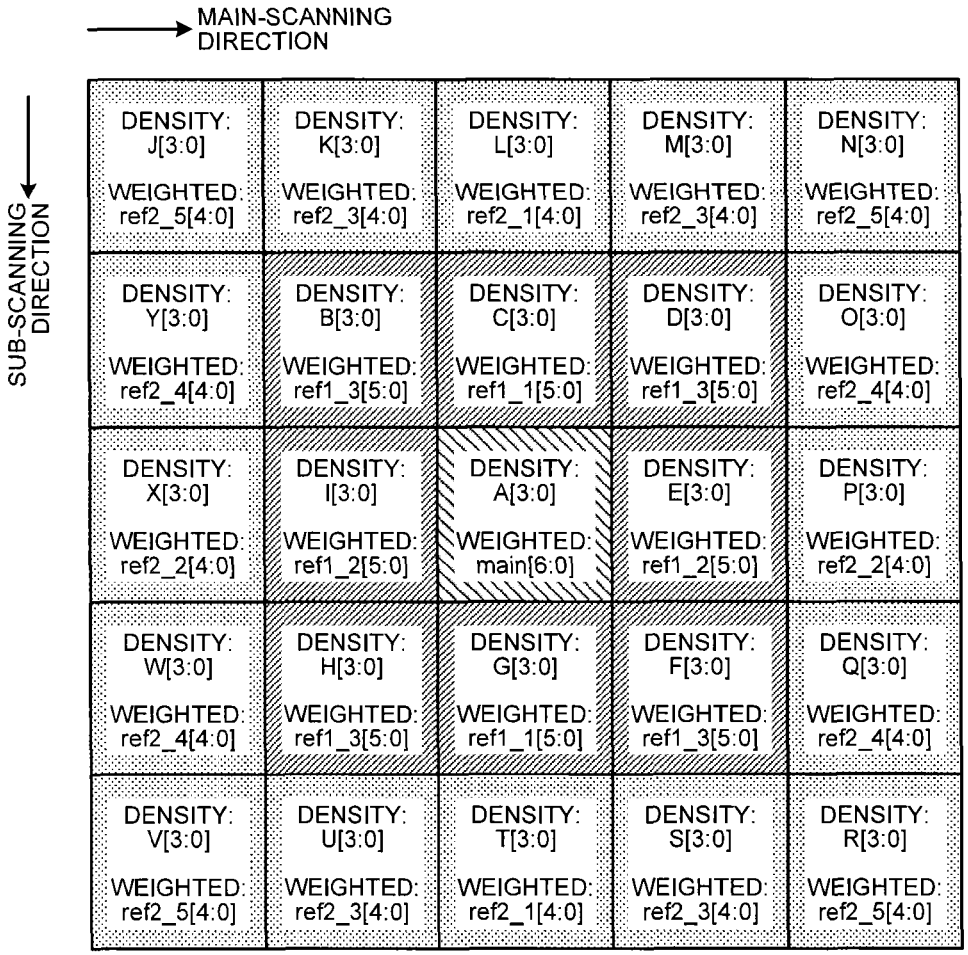
FIG. 5 is an explanatory view illustrating an example of a technique performed by a counter of the embodiment to count toner consumption of a target pixel on the basis of light amounts of surrounding pixels of the target pixel.

FIG. 5 is an explanatory view illustrating an example of a technique performed by the counter 141 of the embodiment to count the toner consumption of a target pixel on the basis of light amounts of the surrounding pixels of the target pixel.

In the embodiment, the counter 141 reads the image data from consecutive five line memories out of the corresponding line memories, extracts from the read image data five pixels in the main-scanning direction and the sub-scanning direction each, and produces data of a 5×5 matrix including a target pixel A at the center of the matrix.

The counter 141 performs y conversion of density data on the produced data matrix in accordance with the characteristics of the LEDA head 32.

Then, the counter 141 sets weighting coefficients for the respective pixels included in the produced data matrix and calculates a total light amount of the target pixel A using the weighting coefficients. Specifically, the counter 141 calculates the total light amount of the target pixel A using Formula (I). The weighting coefficients of reference pixels located at symmetric positions with respect to the target pixel A in the data matrix are set to be equal to each other.

$$\begin{aligned}\text{Total light amount of target pixel } A = {} & A*\text{main}+(C+G)\\ & *\text{ref1_1}+(E+I)*\text{ref1_2}+(B+D+F+H)*\text{ref1_3}+\\ & (L+T)*\text{ref2_1}+(P+X)*\text{ref2_2}+(K+M+S+U)\\ & *\text{ref2_3}+(O+Q+W+Y)*\text{ref2_4}+(J+N+R+V)\\ & *\text{ref2_5}\end{aligned} \tag{1}$$

Subsequently, the counter 141 performs a saturation process. The reason why the saturation process is performed is that the toner consumption in development (also referred to as a toner development amount) is proportional to an amount of light used for exposing the photosensitive drum 22 and saturates at a certain light amount (the upper limit value of the toner development amount), beyond which no toner is used for development. Specifically, the counter 141 sets a corresponding value of the toner consumption of the target pixel A to be equal to the total light amount of the target pixel A when the total light amount of the target pixel A≤ the upper limit value, while the counter 141 sets the corresponding value of the toner consumption of the target pixel A to be equal to the upper limit value when the total light amount of the target pixel A> the upper limit value.

Then, the counter 141 subtracts a constant offset value from the corresponding value of the toner consumption of the target pixel A in order to approximate the corresponding value of the toner consumption of the target pixel A to the actual toner consumption. When the actual toner consumption (a value after subtraction of the offset value) is negative, the actual toner consumption is set to zero.

The counter 141 calculates the total toner consumption consumed in the development of certain image data by performing the above-describe processes on all of the pixels of the certain image data. A surrounding pixel located off the image region is processed as the pixel having a light amount of zero.

The counter 141 counts the toner consumption of the image data whose resolution in the main-scanning direction has been increased L times for the number of pixels that is equal to the number of pixels processed in a single operation of the toner consumption counting. When the skew correction unit 137 increases the sub-scanning resolution of the image data N times, the counter 141 counts the toner consumption of the image data in N separate operations.

Figure 3:
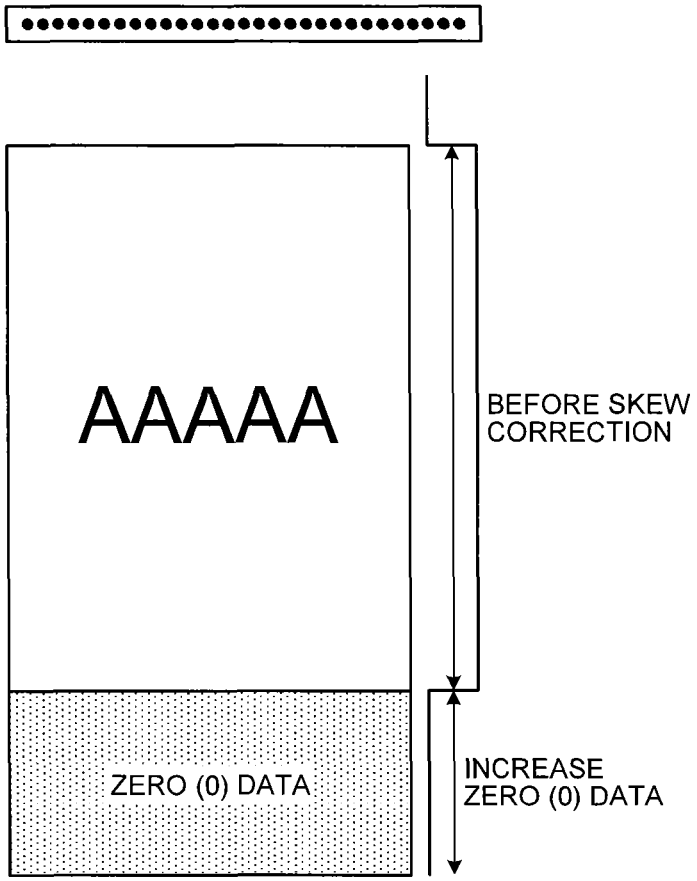
FIG. 3 is a schematic diagram illustrating an example of image data before being subjected to skew correction.
Figure 4:
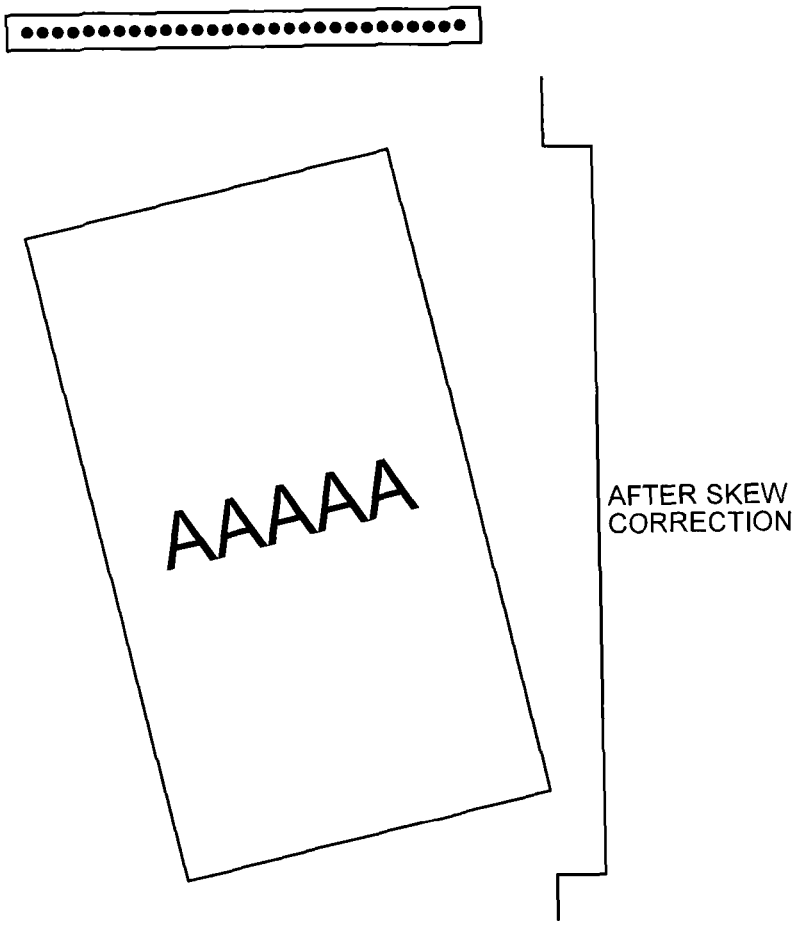
FIG. 4 is a schematic diagram illustrating an example of the image data after the skew correction.

The counter 141 counts the toner consumption of the image data before being subjected to the skew correction and thereafter counts the toner consumption of zero data (refer to FIG. 3). The counter 141 stops the counting when the count value reaches an upper limit.

Figure 6:
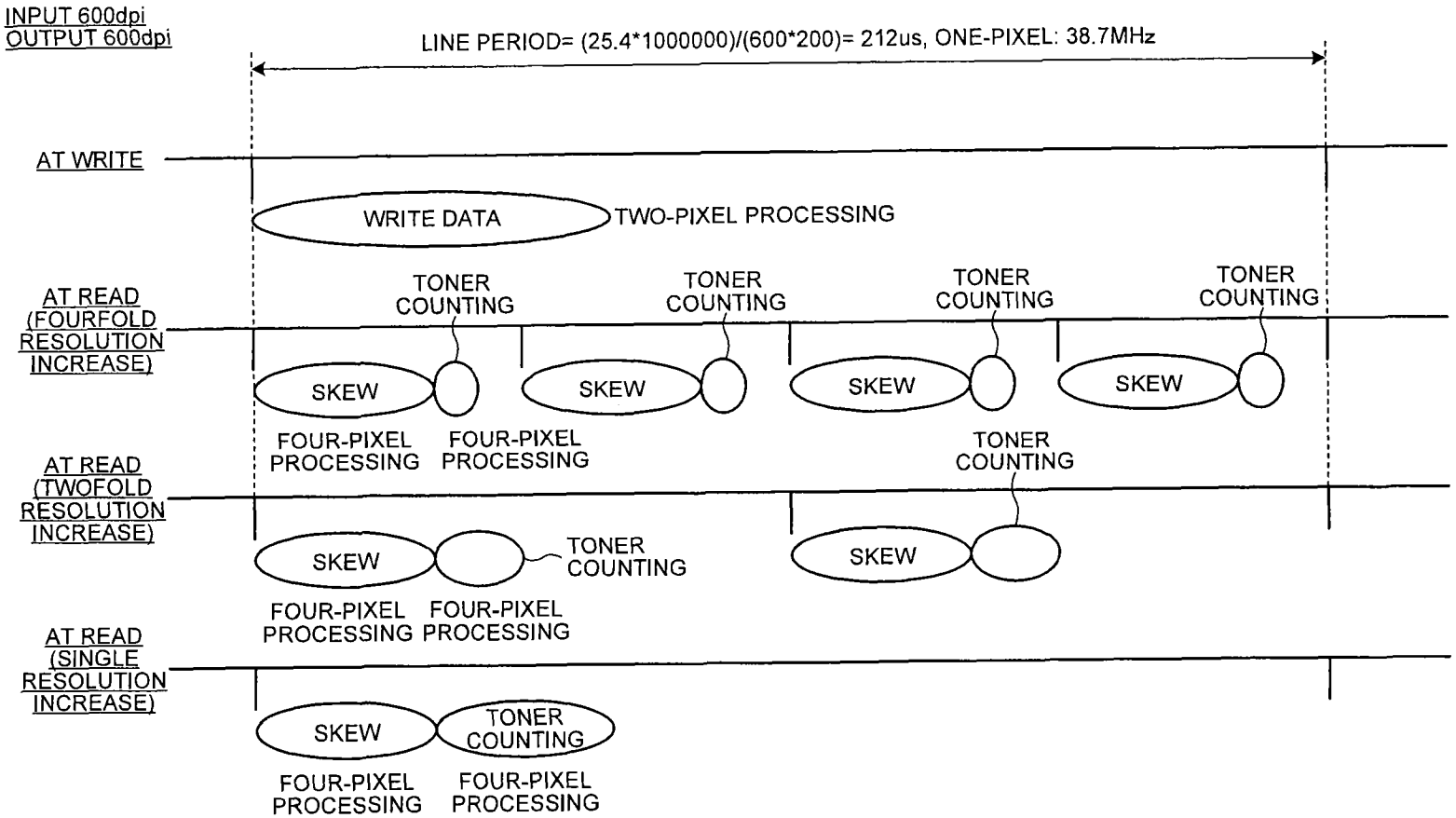
FIG. 6 is an explanatory view illustrating an example of a control technique performed by a skew correction unit and the counter of the embodiment.
Figure 7:
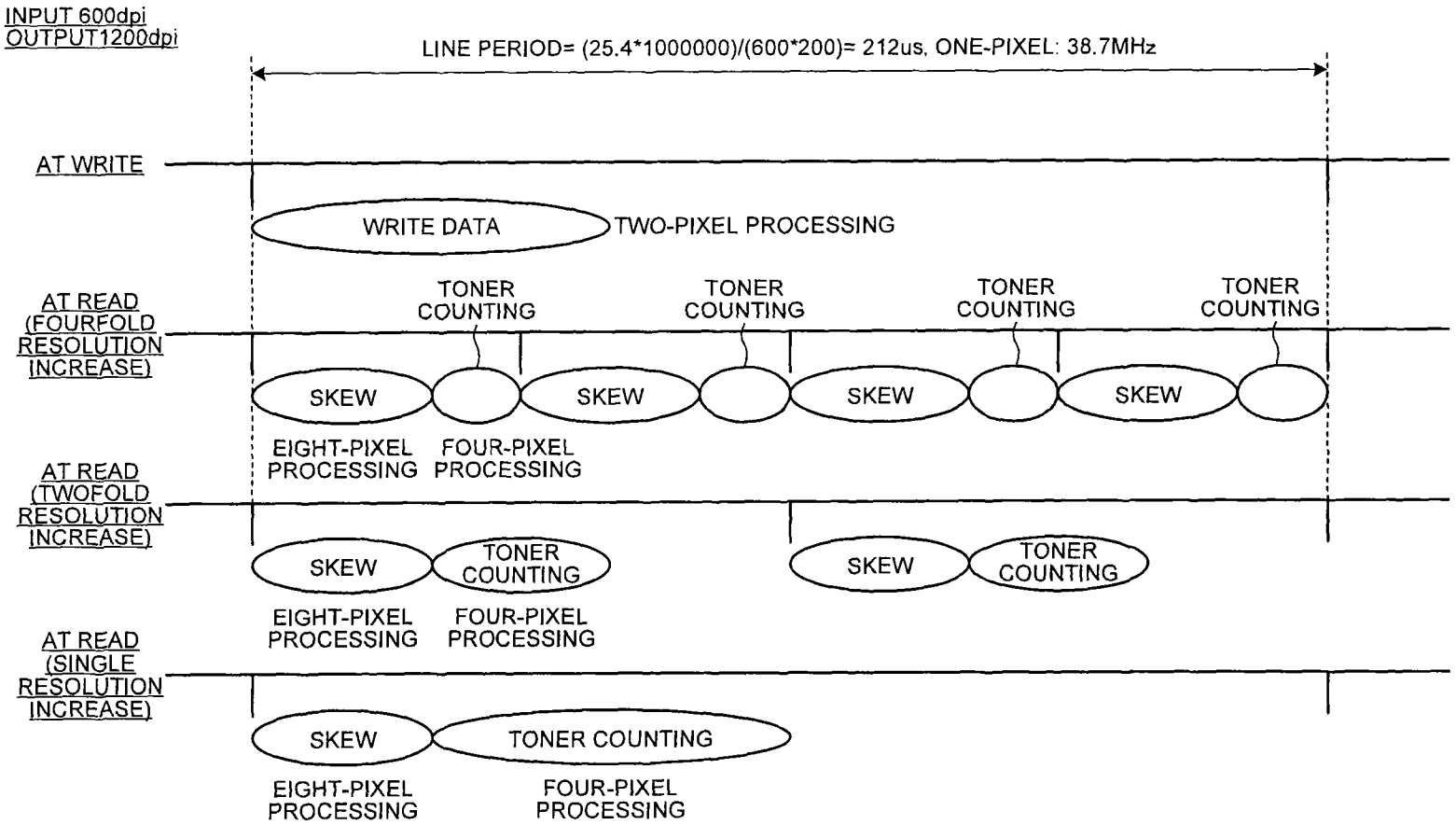
FIG. 7 is an explanatory view illustrating an example of the control technique performed by the skew correction unit and the counter of the embodiment.
Figure 8:
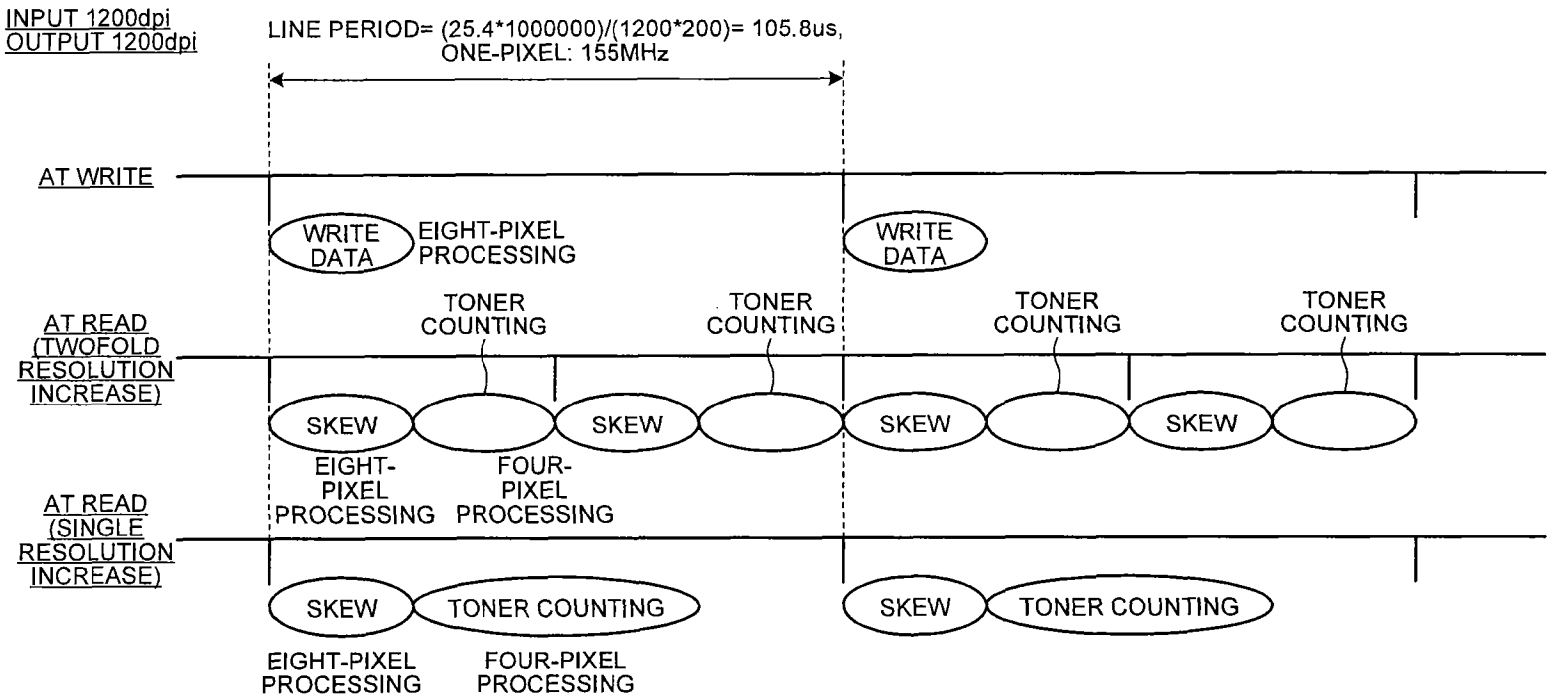
FIG. 8 is an explanatory view illustrating an example of the control technique performed by the skew correction unit and the counter of the embodiment.

FIGS. 6 to 8 are explanatory views illustrating an example of a control technique performed by the skew correction unit 137 and the counter 141 of the embodiment.

In FIG. 6, the image data is input (written) to the line memory at 600 dpi (4 bit) resolution and output (read) from the line memory at 600 dpi (4 bit) resolution. In FIG. 6, the recorder 135 writes write data to the line memory by means of two-pixel processing while the skew correction unit 137 and the counter 141 read processing-target data (read data) from the line memory by means of four-pixel processing and process the data.

In a single resolution increase in which the resolution in the sub-scanning direction of the image data is not increased, the skew correction unit 137 performs the skew correction by means of the four-pixel processing and thereafter the counter 141 counts the toner consumption by means of the four-pixel processing.

In a twofold resolution increase in which the resolution of the sub-scanning direction of the image data is doubled, the skew correction unit 137 performs the skew correction twice by means of the four-pixel processing and, after completion of each skew correction, the counter 141 counts the toner consumption by means of the four-pixel processing. In this case, the number of pixels processed in a single operation of the toner consumption counting performed by the counter 141 and processing time are half of those in the single resolution increase.

In a fourfold resolution increase in which the resolution in the sub-scanning direction of the image data is increased four times, the skew correction unit 137 performs the skew correction four times by means of the four-pixel processing and, after completion of each skew correction, the counter 141 counts the toner consumption by means of the four-pixel processing. In this case, the number of pixels processed in a single toner consumption counting operation performed by the counter 141 and processing time are one fourth of those in the single resolution increase.

In FIG. 7, the image data is input (written) to the line memory at 600 dpi (4 bit) resolution and output (read) from the line memory at 1200 dpi (2 bit) resolution. In FIG. 7, the recorder 135 writes write data to the line memory by means of the two-pixel processing, the skew correction unit 137 reads the processing-target data (read data) from the line memory by means of eight-pixel processing and processes the data, and the counter 141 reads the processing-target data (read data) from the line memory by means of the four-pixel processing and processes the data.

In FIG. 7, the number of pixels processed by the skew correction unit 137 is doubled because the resolution in the main-scanning direction of the image data is doubled while the processing time is equal to that when the resolution in the main-scanning direction of the image data is not increased (refer to FIG. 6). The processing time of the counter 141 is doubled because the number of pixels processed by the counter 141 is equal to that when the resolution in the main-scanning direction of the image data is not increased (refer to FIG. 6).

In the single resolution increase in which the resolution in the sub-scanning direction is not increased, the skew correction unit 137 performs the skew correction by means of the eight-pixel processing and thereafter the counter 141 counts the toner consumption by means of the four-pixel processing.

In the twofold resolution increase in which the resolution in the sub-scanning direction is doubled, the skew correction unit 137 performs the skew correction twice by means of the eight-pixel processing and, after completion of each skew correction, the counter 141 counts the toner consumption by means of the four-pixel processing.

In the fourfold resolution increase in which the resolution in the sub-scanning direction is increased four times, the skew correction unit 137 performs the skew correction four times by means of the eight-pixel processing and, after completion of each skew correction, the counter 141 counts the toner consumption by means of the four-pixel processing.

In FIG. 8, the image data is input (written) to the line memory at 1200 dpi (2 bit) resolution and output (read) from the line memory at 1200 dpi (2 bit) resolution. In FIG. 8, the recorder 135 writes write data to the line memory by means of the eight-pixel processing, the skew correction unit 137 reads the processing-target data (read data) from the line memory by means of the eight-pixel processing and processes the data, and the counter 141 reads the processing-target data (read data) from the line memory by means of the four-pixel processing and processes the data.

In the single resolution increase in which the resolution in the sub-scanning direction is not increased, the skew correction unit 137 performs the skew correction by means of the eight-pixel processing and thereafter the counter 141 counts the toner consumption by means of the four-pixel processing.

In the twofold resolution increase in which the resolution in the sub-scanning direction is doubled, the skew correction unit 137 performs the skew correction twice by means of the eight-pixel processing and, after completion of each skew correction, the counter 141 counts the toner consumption by means of the four-pixel processing.

In the embodiment, the line memories used for the skew correction and the line memories used for counting the toner consumption are in common with each other as described above, thereby enabling the number of line memories to be reduced and the color shift correction and the toner consumption calculation to be performed with high accuracy and at low cost.

MODIFICATIONS

The invention is not limited to the above-described embodiment and various modifications can be made.

First Modification

In the embodiment, the description is made on the basis of full-color printing of four colors. In a first modification, the description is made when monochrome printing or two-color printing is performed.

Figure 9:
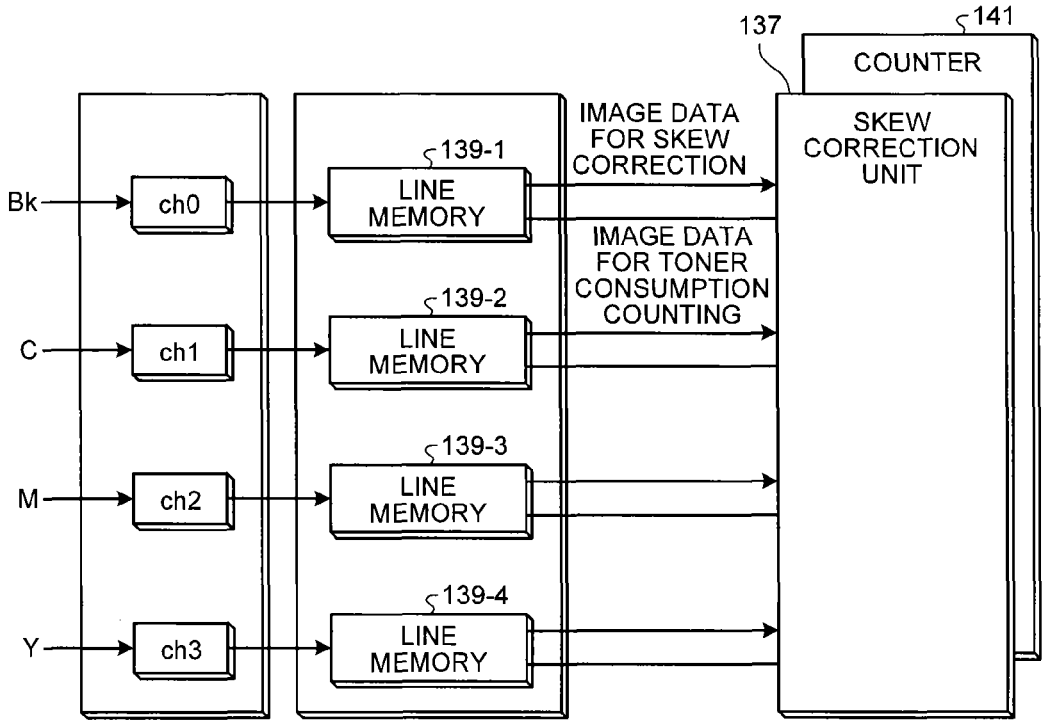
FIG. 9 is an explanatory view of a method for using line memories in full-color printing of four colors of the embodiment.

In the above-described embodiment, as illustrated in FIG. 9, the skew correction unit 137 reads the image data for skew correction and the counter 141 reads the image data for toner consumption counting from the respective line memories 139-1 to 139-4. In the monochrome printing and the two-color printing, however, the line memories provided for colors that are not used in the printing remain unused.

Therefore, in the first modification, the recorder 135 also sequentially records the image data into the line memories provided for colors that are not used in the monochrome printing or the two-color printing, and the counter 141 sequentially reads the image data from the line memories provided for colors that are not used in the monochrome printing or the two-color printing and counts the toner consumption of the target pixel on the basis on the light amounts of the surrounding pixels of the target pixel.

Figure 10:
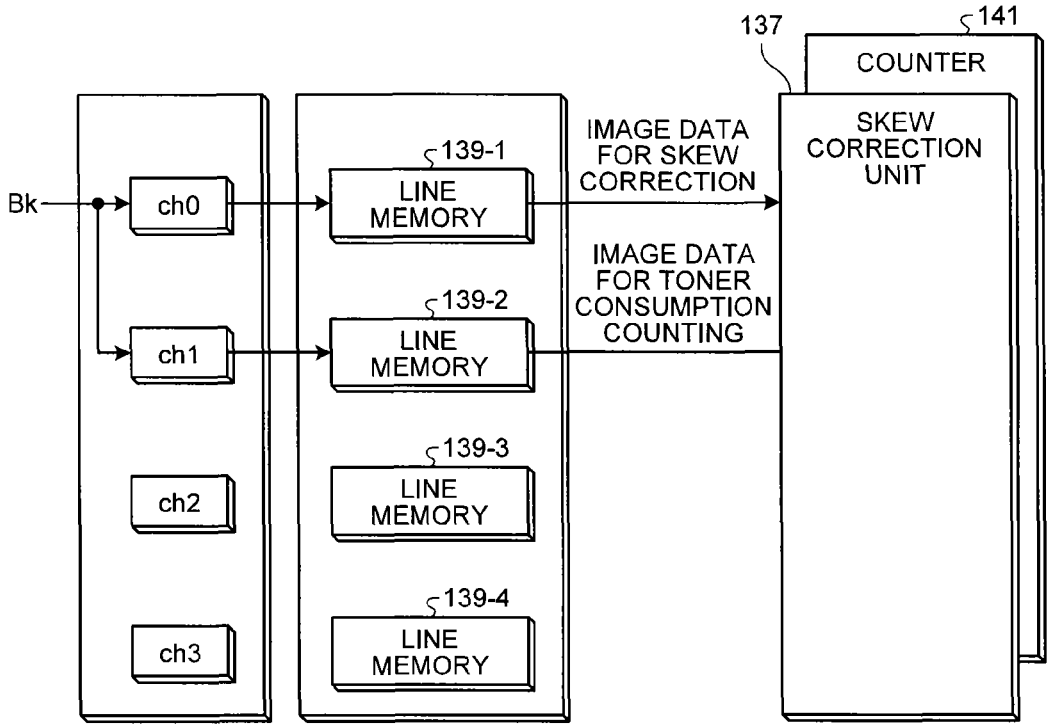
FIG. 10 is an explanatory view of a method for using the line memories in monochrome printing of a first modification.

For example, in the monochrome printing, as illustrated in FIG. 10, the recorder 135 records the image data of black (Bk) not only into the line memory 139-1 but also into the line memory 139-2 while the counter 141 reads the image data not only from the line memory 139-1 but also from the line memory 139-2 and counts the toner consumption of the target memory.

Figure 11:
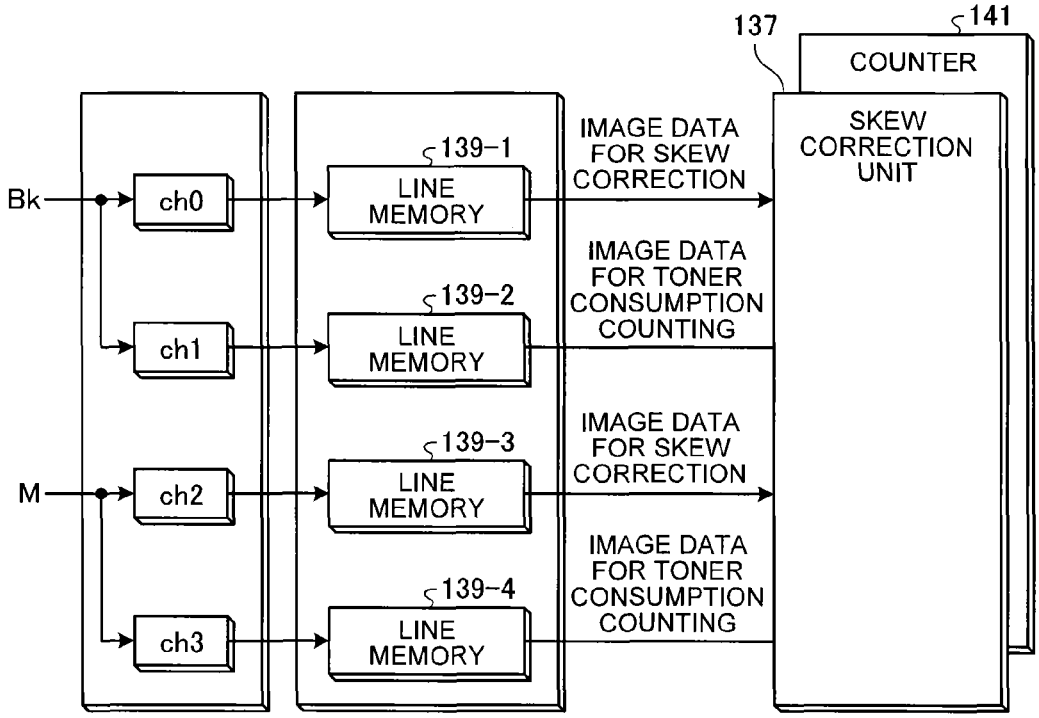
FIG. 11 is an explanatory view of a method for using the line memories in two-color printing of the first modification.
Figure 12:
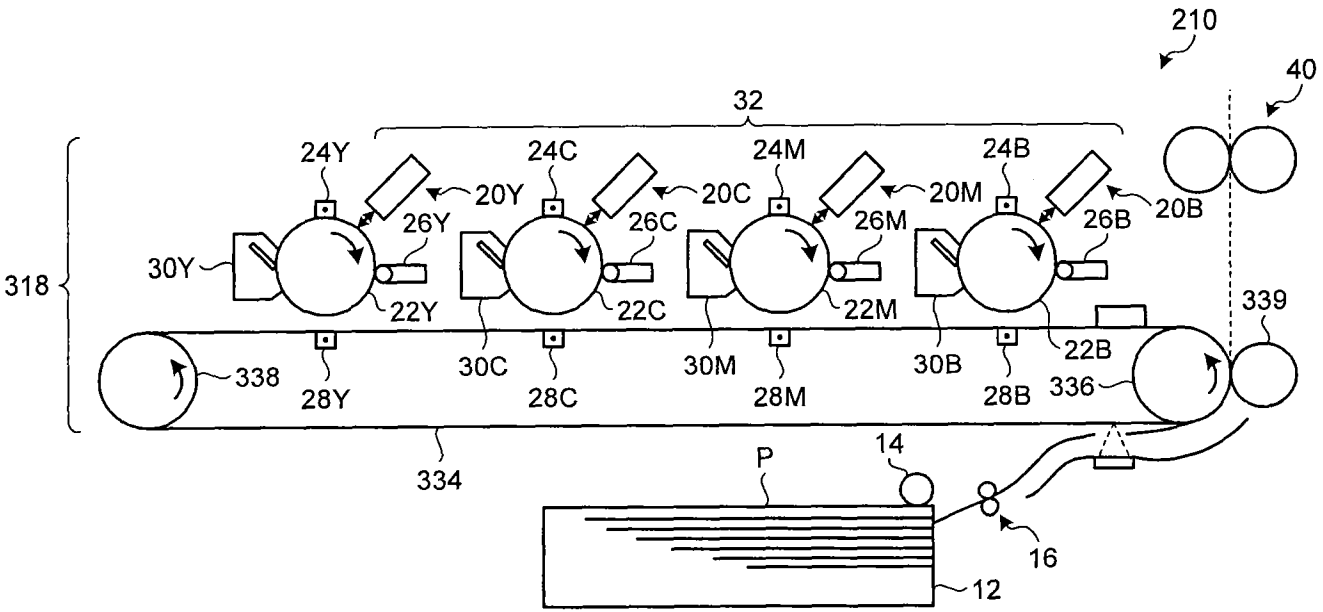
FIG. 12 is a schematic diagram illustrating an example of a mechanical structure of a printing apparatus of a third modification.
Figure 13:
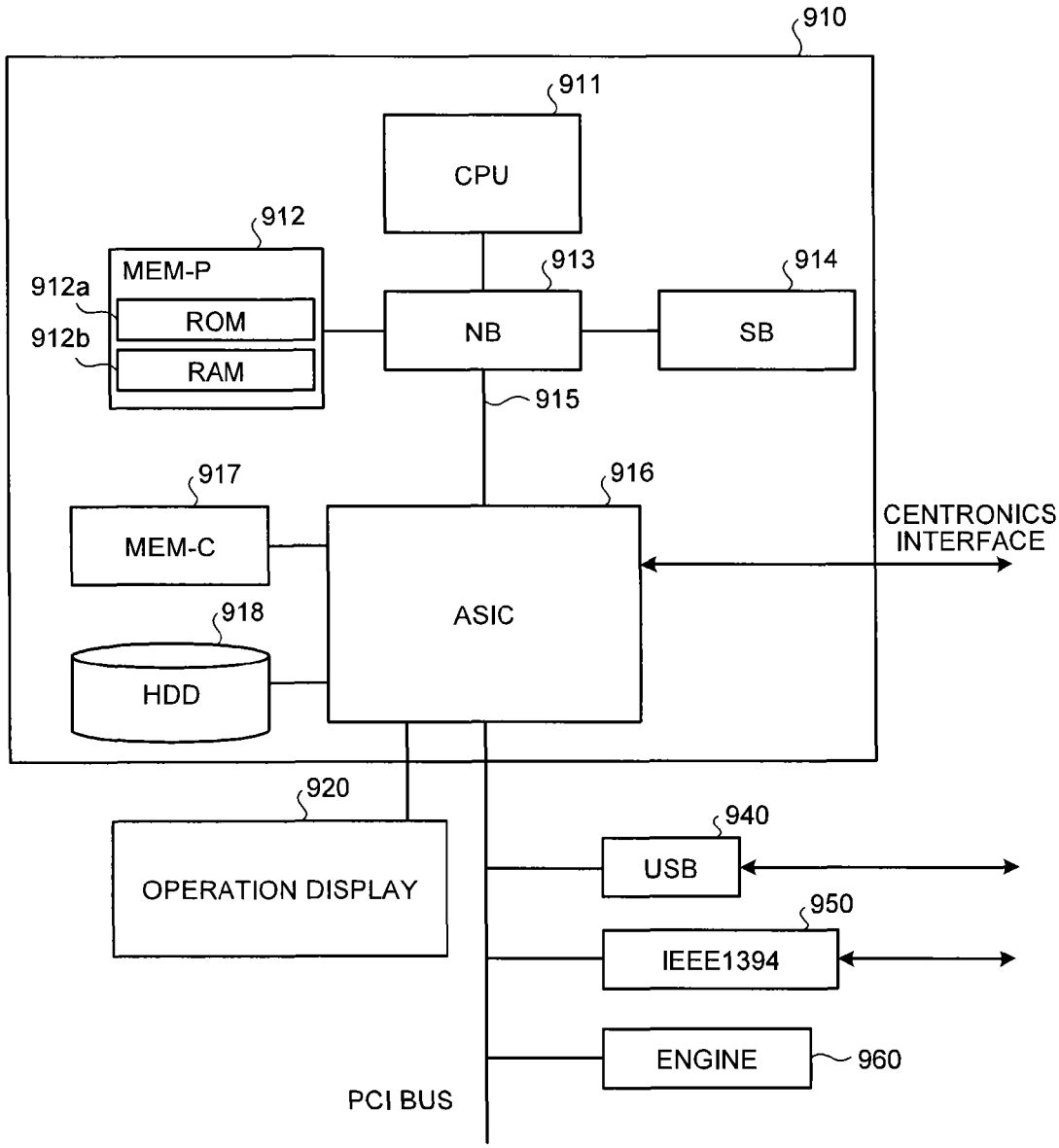
FIG. 13 is a block diagram illustrating an exemplary hardware structure of the printing apparatuses of the embodiment and modifications.

For example, in the two-color printing, as illustrated in FIG. 11, the recorder 135 records the image data of black (Bk)

not only into the line memory 139-1 but also into the line memory 139-2 while the counter 141 reads the image data not only from the line memory 139-1 but also from the line memory 139-2 and counts the toner consumption of the target memory. Likewise, the recorder 135 records the image data of magenta (M) not only into the line memory 139-3 but also into the line memory 139-4 while the counter 141 reads the image data not only from the line memory 139-3 but also from the line memory 139-4 and counts the toner consumption of the target memory.

As a result, deterioration of performance in a linear speed due to the common use of the line memories can be prevented.

Second Modification

For example, the counter 141 and the skew correction unit 137 may read the image data simultaneously from the line memories by setting the number of pixels processed in a single operation of the skew correction performed by the skew correction unit 137 to equal to the number of pixels processed in a single operation of the toner consumption counting performed by the counter 141.

Third Modification

In the embodiment, the line memories used for the skew correction are used for counting the toner consumption because it is preferable for counting the toner consumption with high accuracy to form a large data matrix using a large number of line memories. The line memories used for counting the toner consumption are not limited to the line memories used for the skew correction.

For example, the line memory 133 used by the frequency converter 131 for frequency conversion or the line memory used by the image processor 135 for image processing may be used for counting the toner consumption. Examples of the image processing include processing to correct characteristics of the image data, jaggy correction processing, and dithering.

As another example, a line memory used by a frequency converter (not illustrated) that converts a transfer frequency of the image data based on the operation frequency of the LEDA controller 130 into that based on the operation frequency of the LEDA head 32 may be used for counting the toner consumption. As still another example, a line memory used by an arrangement converter (not illustrated) that converts the data arrangement in accordance with the type of LEDA head 32 may be used for counting the toner consumption. As still another example, a line memory used by a period variation correction unit (not illustrated) that corrects the period variation in the sub-scanning direction may be used for counting the toner consumption.

Fourth Modification

In the embodiment, the LEDA head 32 serves as an exposing mechanism. The exposing mechanism may be achieved by a laser diode (LD) head or an organic electroluminescence (EL) head.

Fifth Modification

In the embodiment, each image forming unit forms an image directly on the recording sheet. Each image forming unit may form an image on an intermediate transfer belt and the image may be transferred to the recording sheet from the intermediate transfer belt. In the following description, differences from the embodiment are primarily described. The same name and reference numeral of the embodiment are given to the element having the same function, and description thereof is not repeated.

FIG. 5 is a schematic diagram illustrating an example of a mechanical structure of a printing apparatus 210 of a fifth modification. As illustrated in FIG. 5, the printing apparatus 210 differs from that of the embodiment in that an image forming unit 318 includes an intermediate transfer belt 334, a driving roller 336, and a driven roller 338 instead of the conveying belt 34, the driving roller 36, and the driven roller 38, and further includes a secondary transfer roller 339.

The intermediate transfer belt 334 is an endless belt winded and circulated between the driving roller 336 and the driven roller 338. The intermediate transfer belt 334 is moved to the image forming sections 20B, 20M, 20C, and 20Y in this order in an endless manner by the driving roller 336 rotated by a driving motor (not illustrated).

First, the image forming section 20B transfers a black toner image onto the intermediate transfer belt 334. Then, the image forming sections 20M, 20C, and 20Y transfer a magenta toner image, a cyan toner image and a yellow toner image onto the intermediate transfer belt 334 in an overlapped manner, respectively. As a result, a full-color image is formed on the intermediate transfer belt 334.

The recording sheet P is sent from the separation roller pair 16 onto the intermediate transfer belt 334 on which the image has been formed. The image is transferred from the intermediate transfer belt 334 to the recording sheet P at a secondary transfer position at which the intermediate transfer belt 334 and the recording sheet P make contact with each other.

The secondary transfer roller 339 is disposed at the secondary transfer position. The secondary transfer roller 339 presses the recording sheet P to the intermediate transfer belt 334 at the secondary transfer position. This pressing contact enhances transfer efficiency. The secondary transfer roller 339 makes close contact with the intermediate transfer belt 334, and thus has no contact-removal mechanism.

Hardware Structure

FIG. 6 is a block diagram illustrating an exemplary hardware structure of the printing apparatuses of the embodiment and the modifications. As illustrated in FIG. 6, the printing apparatus of the embodiment and each modification includes a controller 910 and an engine unit (or engine) 960 that are coupled through a peripheral component interconnect (PCI) bus. The controller 910 controls the whole of the multifunction peripheral, drawing, communications, and input from an operation display 920. The engine 960 is a printer engine that can be coupled with the PCI bus. Examples of the engine 960 include a monochrome plotter, a single-drum color plotter, a four-drum color plotter, a scanner and a facsimile unit. The engine 960 includes a section for image processing such as error diffusion and gamma conversion in addition to the so-called engine such as the plotter.

The controller 910 includes a CPU 911, a north bridge (NB) 913, a system memory (MEM-P) 912, a south bridge (SB) 914, a local memory (MEM-C) 917, an ASIC 916, and a hard disk drive (HDD) 918. The north bridge (NB) 913 and the ASIC 916 are coupled through an accelerated graphics port (AGP) bus 915. The MEM-P 912 includes a ROM 912*a* and a RAM 912*b*.

The CPU 911 controls the whole of the multifunction peripheral, and includes a chipset composed of the NB 913, the MEM-P 912, and the SB 914. The multifunction peripheral is coupled with other apparatuses through the chipset.

The NB 913 is a bridge for coupling the CPU 911 with the MEM-P 912, the SB 914, and the AGP bus 915. The NB 913 includes a memory controller for controlling writing to the MEM-P 912, a PCI master, and an AGP target.

The MEM-P 912 is a system memory used for a storage memory of programs and data, a development memory of programs and data, and a drawing memory of a printer, for example. The MEM-P 912 is composed of the ROM 912*a* and the RAM 912*b*. The ROM 912*a* is a read only memory used for a storage memory of programs and data. The RAM 912*b* is a writable and readable memory used for a development memory of programs and data and a drawing memory of a printer, for example.

The SB 914 is a bridge for coupling the NB 913 with PCI devices and peripheral devices. The SB 914 and the NB 913 are coupled through the PCI bus, with which a network interface (I/F) section, for example, is coupled.

The ASIC 916 is an integrated circuit (IC) for image processing and includes hardware for image processing. The ASIC 916 serves as a bridge for coupling the AGP bus 915, the PCI bus, the HDD 918, and the MEM-C 917 with itself. The ASIC 916 is composed of the PCI target, the AGP master, an arbiter (ARB) that is the core of the ASIC 916, a memory controller that controls the MEM-C 917, a plurality of direct memory access controllers (DMACs) that carry out image data rotation with hardware logics, and a PCI unit that carries out data transfer between itself and the engine 960 through the PCI bus. The ASIC 916 is coupled with a universal serial bus (USB) 940, and an Institute of Electrical and Electronics Engineers 1394 (IEEE1394) interface 950 through the PCI bus. The operation display 920 is directly connected to the ASIC 916.

The MEM-C 917 is a local memory used for a copying image buffer and a code buffer. The HDD 918 is a storage for storing image data, programs, font data, and forms.

The AGP bus 915 is a bus interface for a graphic accelerator card and has been developed to carry out graphic processing with high speed. The AGP bus 915 allows a graphic accelerator card to operate at high speed with direct access to the MEM-P 912 at a high throughput.

According to the invention, the color shift correction and the toner consumption calculation can be performed with high accuracy and at low cost.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A toner consumption calculator, comprising:

a plurality of line memories;

a recorder that sequentially records image data including a plurality of pixels into the line memories;

a skew correction unit that performs skew correction on the image data by sequentially reading the image data from the line memories while controlling read timing; and a counter that sequentially reads the image data from the line memories and counts toner consumption of a target pixel on the basis of light amounts of surrounding pixels of the target pixel, wherein the counter reads the image data from the line memories while the skew correction unit reads no image data from the line memories.

2. The toner consumption calculator according to claim 1, wherein the number of pixels processed in a single operation of the skew correction performed by the skew correction unit and the number of pixels processed in a single operation of toner consumption counting performed by the counter differ from each other.

3. The toner consumption calculator according to claim 1, wherein the number of pixels processed in a single operation of the skew correction performed by the skew correction unit is equal to the number of pixels processed in a single operation of toner consumption counting performed by the counter, and the counter and the skew correction unit read the image data simultaneously from the line memories.

4. The toner consumption calculator according to claim 1, wherein the skew correction unit performs skew correction on the image data whose resolution in a main-scanning direction has been increased L times (L is a natural number) by increasing the number of pixels processed in a single operation of the skew correction L times, and the counter counts the toner consumption of the image data whose resolution in the main-scanning direction has been increased L times for the number of pixels that is equal to the number of pixels processed in a single operation of the toner consumption counting.

5. The toner consumption calculator according to claim 1, wherein the skew correction unit increases resolution in a sub-scanning direction of the image data N times (N is a natural number) by reading the image data N times, and the counter counts the toner consumption of the image data in N separate operations.

6. The toner consumption calculator according to claim 1, wherein each line memory is provided for a corresponding color of a plurality of colors of the image data, in monochrome printing or two-color printing, the recorder also sequentially records the image data into the line memories provided for colors that are not used in the monochrome printing or the two-color printing, and the counter sequentially reads the image data from the line memories provided for the colors not used and counts the toner consumption of the target pixel on the basis of the light amounts of the surrounding pixels.

7. The toner consumption calculator according to claim 1, wherein the counter counts the toner consumption of the image data before being subjected to the skew correction and thereafter counts the toner consumption of zero data.

8. The toner consumption calculator according to claim 1, wherein the counter stops counting when a count value reaches an upper limit.

9. An image forming apparatus, comprising the toner consumption calculator according to claim 1.

10. A toner consumption calculation method, comprising:

by a recorder, sequentially recording image data including a plurality of pixels into a plurality of line memories;

by a skew correction unit, performing skew correction on the image data by sequentially reading the image data from the line memories while controlling read timing; and by a counter, sequentially reading the image data from the line memories and counting toner consumption of a target pixel on the basis of light amounts of surrounding pixels of the target pixel, wherein the counter reads the image data from the line memories while the skew correction unit reads no image data from the line memories.

* * * * *